US005398619A

United States Patent [19]

Buccos

[11] Patent Number: 5,398,619

[45] Date of Patent: Mar. 21, 1995

[54] MODEL TRAIN TRUCK ASSEMBLY

[75] Inventor: Peter C. Buccos, Marysville, Mich.

[73] Assignee: Lionel Trains, Inc., Chesterfield, Mich.

[21] Appl. No.: 110,058

[22] Filed: Aug. 20, 1993

[51] Int. Cl.[6] ..... B61F 5/00

[52] U.S. Cl. ..... 105/157.2

[58] Field of Search ..... 105/1.5, 3, 4.1, 4.2, 105/4.3, 157.1, 157.2

[56] References Cited

U.S. PATENT DOCUMENTS

| | | | |
|---|---|---|---|
| 1,542,139 | 6/1925 | Ives | 105/157.2 |
| 2,133,530 | 10/1938 | Beutlich | 105/157.2 |
| 2,556,952 | 6/1951 | Wojtowicz | 105/157.2 |
| 2,987,851 | 6/1961 | Bonanno | 105/157.2 |
| 3,064,588 | 11/1962 | Zion | 105/157.2 |
| 3,120,080 | 2/1964 | Hahn | 105/157.2 |
| 3,397,483 | 8/1968 | Lingard | 105/157.2 |
| 3,518,790 | 7/1970 | Zamarra | 105/157.2 |
| 4,236,457 | 12/1980 | Cope | 105/157.2 |

FOREIGN PATENT DOCUMENTS

| | | | |
|---|---|---|---|
| 2309852 | 8/1974 | Germany | 105/157.2 |
| 1277460 | 6/1972 | United Kingdom | 105/157.2 |

*Primary Examiner*—Mark T. Le

*Attorney, Agent, or Firm*—Harness, Dickey & Pierce

[57] ABSTRACT

A modular toy train truck assembly includes a frame having an integrally casted center plate and bolster plate connected to a pair of ornamental side frames that may be easily modified during the casting process to replicate various truck styles. Connected to the frame is a universal chassis comprised of a pair of wheel assemblies and a pair of bearing inserts whereby the wheel assemblies are journalled to the bearing inserts. Depending upon the style of truck, the side frames are provided with coils that are held in place by a flange integral with each insert. This unique design allows a modular truck frame to be easily retrofitted with a variety of accessories that may be attached to the truck frame by the customer.

19 Claims, 4 Drawing Sheets

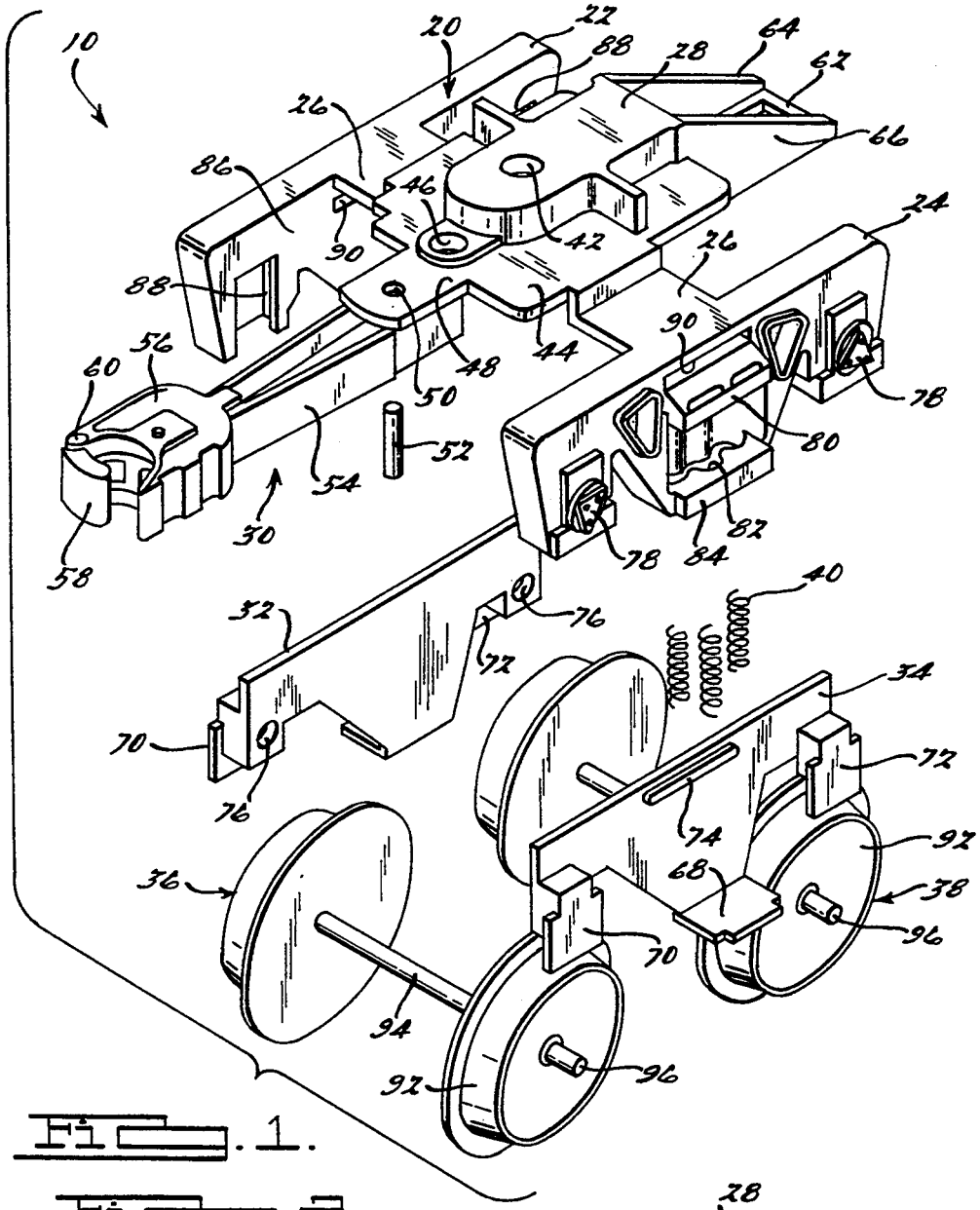
Fig. 1.
Fig. 2.
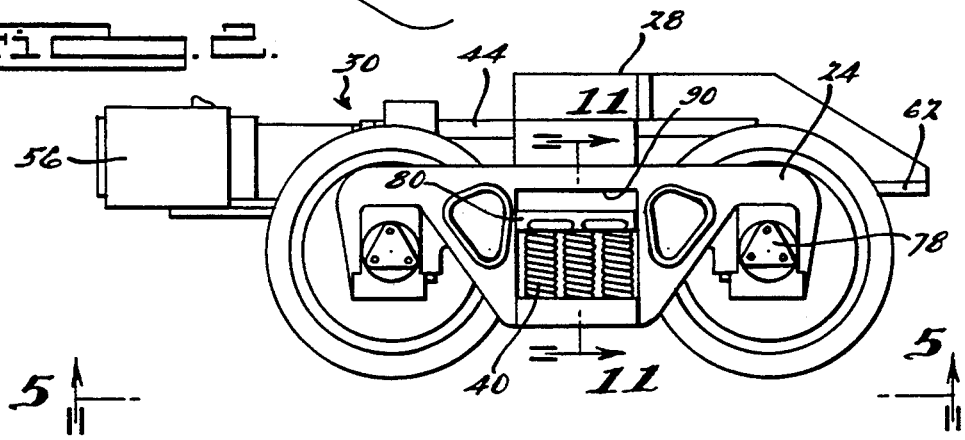

MODEL TRAIN TRUCK ASSEMBLY

FIELD OF THE INVENTION

The present invention relates generally to a model train truck assembly and, more particularly, to a modular toy train truck assembly that uses a universal wheel assembly in conjunction with a truck frame whereby said truck frame may be easily modified during the casting process to have any one of a variety of side frame styles as well as to allow the customer to retrofit ;various accessories to the truck frame.

BACKGROUND OF THE INVENTION

It is well understood in the toy train truck art to provide a truck assembly having a conventional pair of longitudinally spaced wheel sets, each wheel set having an axle with a wheel mounted to each end of the axle. The wheel sets are supported by side frames which maintain the wheel sets in fixed relationship to one another. The side frames are joined together by a common bolster which normally provides a center mounting pad that attaches to the underside of a railway vehicle car body in a conventional matter.

Toy train truck assemblies are generally designed for a specific purpose, that is, for use in conjunction with a specific car body, for example, a passenger car, a caboose, a boxcar, a tender, or a diner car: In order to replicate the full-scale trains that are normally found in railway systems, it has been necessary to provide each car body with a specific truck assembly. As such, a multitude of model toy train truck assemblies have been created in order to satisfy the customer demand for a truck assembly that replicates each type of large scale truck design. In the past, this has required toy train manufacturers to use separate tooling for each type of truck assembly. This obviously is costly to the manufacturer who must ultimately pass along such costs to the customer.

Therefore, there is a need to provide a modular toy train truck assembly that allows a basic toy train truck design to be employed with the various car bodies that are manufactured which is adapted for use with either a fixed arm or an articulating arm. Also, there is a need to provide a modular toy train truck assembly that may be easily modified by the customer in order to add accessories to the train truck assembly.

SUMMARY OF THE INVENTION

Accordingly, it is an object of the present invention to provide a modular toy train truck assembly that overcomes the problems associated with conventional toy trains. Such a truck assembly should be simple in design and should allow a modular truck assembly to be used with the various;, car bodies and also allow the end-user to add accessories to the truck.

A first preferred form of the present invention provides as one of its aspects, a novel toy train truck assembly that may be used with various toy train car bodies. The truck assembly comprises a one-piece die cast metal frame which includes an integral bolster plate, center plate, and a pair of side frames. A coupler arm assembly is attached to the center plate and may include either a fixed coupler arm and/or an articulating coupler arm having self-centering means. Also, a novel bearing insert is provided which is secured to each side frame. The bearing insert preferably includes a spring retaining flange for keeping springs positioned within the end frames, a locating tab for securing the bearing insert to each end frame and bearing means for journalling the axles of a wheel assembly thereto. The wheel assembly is rotatably connected to the bearing means of the inserts and includes metallic wheels connected to distal ends of the axle. In addition, coil Springs are retained within the side frames to provide an authentic full-scale finished look to the truck assembly.

A second preferred form of the present invention provides as one of its aspects, a novel toy train truck assembly having a frame including an integral bolster, center plate and side frames; a coupler arm connected to said frame; a bearing insert positioned within each of said side frames; a wheel assembly rotatably connected to said bearing inserts; and accessories attachable in a conventional form to the frame. The accessories may include roller pick-ups for power transmission through a third rail of the track, slide contacts for power transmission through a fourth or a fifth rail of the track, a ground strap for ground power transmission through the track, or a switch and a cam assembly which coordinates With one another to aid in generating rail sounds.

A third preferred form of the present invention provides as one of its aspects, a modular toy train truck assembly that may have the truck frame cast from a single set of tooling that is operable to change the appearance of the side frames in order to create various truck styles that may be used with freight cars, caboose cars or passenger cars, etc. Such modular design provides a single generic cast frame that may be easily modified prior to being casted by using tooling that contains optional side slides that are operable to modify the external configuration of the side frames during the casting process in order to produce the various truck styles discussed herein.

For the following specification taken in conjunction with the accompanying drawings and the appended claims, other objects, features and advantages of the present invention will become apparent to those skilled in the art.

BRIEF DESCRIPTION OF THE DRAWINGS

FIG. 1 is an exploded view of the novel toy train truck assembly illustrating its primary components;

FIG. 2 is a side elevational view of a toy train truck assembly having a freight-truck side frame style;

DETAILED DESCRIPTION OF THE PREFERRED EMBODIMENT

Figure 3:
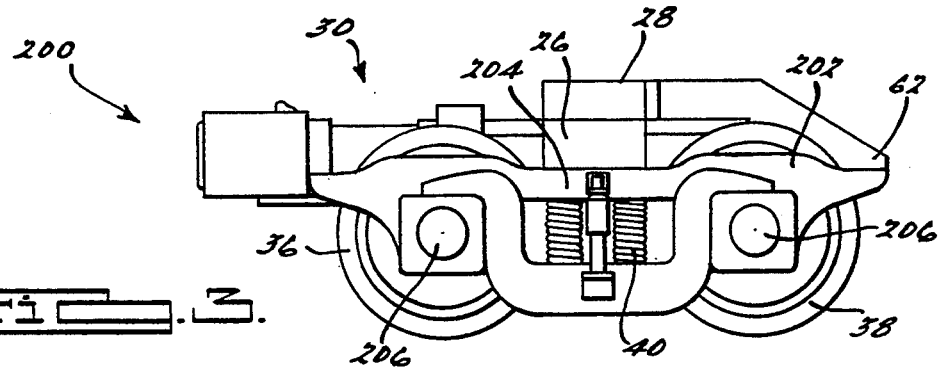
FIG. 3 is a side elevational view of a toy train truck assembly having a passenger-truck side frame style.

As illustrated by the exploded view of FIG. 1, a novel toy train truck assembly 10 is illustrated which includes a one-piece frame 20 preferably made of zinc die cast. The frame 20 includes a number of integral components including a pair of side frames 22 and 24 that are connected to a common bolster plate 26 that is, in turn, supported by a center plate 28. Truck assembly 10 also includes a fixed coupler arm assembly 30 which is connected to the center plate 28 and a pair of plastic inserts 32 and 34 which partially fit into side frames 22 and 24, respectively. In addition, a pair of wheel assemblies 36 and 38 are journalled to the inserts 32 and 34. Coil springs 40 are further provided and are housed within the side frames 22 and 24 to provide an authentic look in order to replicate a full-scale train. As will be detailed, inserts 32 and 34 and wheel assemblies 36 and 38 can be pre-assembled into a universal chassis assembly adapted for assembly to frame 20.

With reference to FIGS. 1 and 2, the center plate 28 includes a central bore 42 that is operable to receive a screw or rivet (not shown) that pivotally connects the truck assembly 10 to a car body (not shown). The center plate 28 further includes an integral lower base plate 44 comprised of a vertically extending bore 46 and an axially extending flange 48 which extends outward from the lower plate 44 and includes a coupler arm bore 50 that is operable to receive a standard snap-fit type fastener 52 so that the coupler arm assembly 30 may be properly secured to the flange 48. The coupler arm assembly 30 is preferably made of plastic and includes a coupler armature 54 that has a coupler head 56 fixed to its free end and a knuckle 58 that is pivotably connected by a metal pivot pin 60 to the coupler head 56. On the opposing end of the center plate 28 and the lower plate 44 there is integrally casted thereto a roller pick-up mounting flange 62 and a pair of vertically extending slanted side walls 64 and 66 which provide a mounting pad for the electromechanical roller pick-up accessory illustrated in FIG. 8.

The inserts 32 and 34 are preferably made of a plastic material, for example "CELCON", an acetal copolymer which is manufactured by Hoechst Celanese International, and include an integrally molded horizontally extending coil retainer flange 68, a pair of vertically extending flanges 70 and 72 and a centrally disposed tab 74 which snaps into the slot 90 located in each side frame 22 and 24. Each insert further includes a pair of bearing means Or journals 76 that are of sufficient size to receive and allow free rotation therein the ends 96 of the axles 94.

With continued reference to FIGS. 1 and 2, a side frame 24 (a mirror image of side frame 22) is illustrated which closely resembles that of a freight truck. The side frame 24 is integral with the bolster plate 26 and is ornamental in design to include pedestal jaws 78 at opposite ends thereof and further includes a coil housing 80 that is operable to house a plurality of coils 40. The coil housing 80 includes a plurality of holes 82 located through a lower coil guide 84 which acts in concert with coil retainer flange 68 of the insert 34 to securely position the coils 40 within the side frame 24. The opposing side 86 of the side frames have a pair of channels 88 formed therein which act as guides for receiving flanges 70 and 72. Also, each side frame has an axially extending slot 90 which passes through the side frame and is operable to receive tab 74 once the insert 34 engages or snaps to the side frame 24.

The wheel assemblies 36 and 38 each include a pair of wheels 92, preferably made of powered metal, that are press fit ;.onto a standard roller pin axle 94 that has ends 96 that are journalled within the pair of journals 76 of each insert. Once the wheel assemblies are positioned within the journals 76, and the inserts 32 and 34 and are appropriately inserted within the side frames 22 and 24, a durable wheel assembly is created that allows each wheel set to freely rotate with respect to the inserts 32 and 34.

FIG. 3 illustrates a passenger truck assembly 200 that represents an alternative embodiment whereby a passenger truck side frame 202 may be employed with the previously described basic structural components. Where possible, like numbers will be used to describe the same features. The passenger truck side frame 202 includes a pair of coils 40 that are recessed within a coil housing 204 that serves an ornamental purpose only. Also, a pair of ornamental pedestals 206 are used to authenticate the ornamental nature of this design. The remaining components of the passenger truck assembly 200 are the same as that previously discussed. That is, a conventional coupler assembly 30 is attached to a center plate 28, the roller pick-up mounting flange 62 is integral with the center plate 28 and the universal chassis assembly which includes wheel assemblies 36 and 38 and bearing inserts 32 and 34 that are secured to the side frames.

Figure 4:
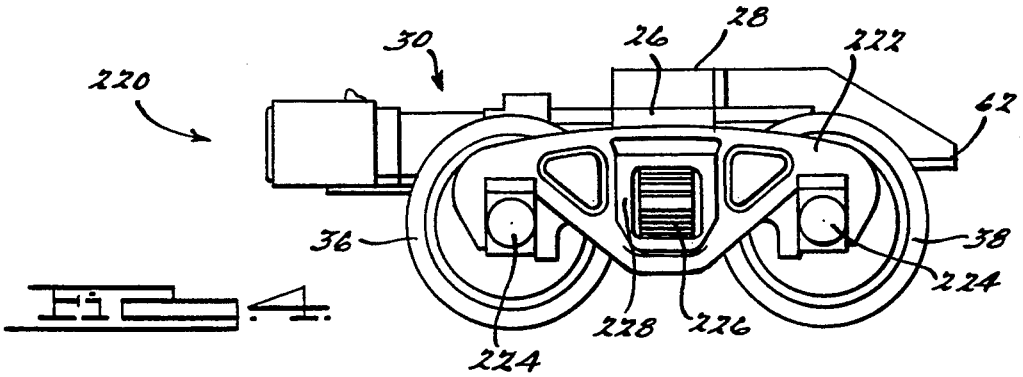
FIG. 4 is a side elevational view of a toy train truck assembly having a caboose-truck side frame style.

FIG. 4 illustrates another alternative embodiment where a caboose truck assembly 220 is shown and includes the previously described basic structural components in addition to a unique caboose truck side frame 222 that has a pair of ornamental pedestal jaws 224 and a nonfunctional leaf spring 226 located within a spring housing 228. The side frame 222 is integral with the bolster plate 26 and is further ornamentally configured in order to replicate the side frame of a full-scale train.

The truck assemblies 10, 200 and 220 are modular in design in that they all employ a common bolster plate 26, center plate 28, coupler arm assembly 30 or 112, and a universal chassis made up of wheel assemblies 36 and 38 and inserts 32 and 34. One of the unique aspects of this design is the option of providing these components with the different side frames that are illustrated in FIGS. 2, 3 and 4, through the use of modifying the tooling prior to die casting the frame. By providing various side slides (not shown), the die cast tooling used to cast these side frames can be easily modified in order to create various side frames, i.e., a freight truck side frame 24, a passenger truck side frame 200 or a caboose truck side frame 220. It will be appreciated that other side frames may be employed, for example, a diner car side frame, with this modular truck design. By employment of this modular truck design, it is possible for a manufacturer to use a single generic set of tooling in order to create a multitude of truck frames. Furthermore, this modular truck design allows for a common truck frame to be used for either a fixed or an articulating coupler arm as well as to allow various accessories to be attached to the frame either during the manufacturing stage or by the customer. A discussion of some of the various accessories that the customer may attach to this modular truck assembly will now be presented.

Figure 5:
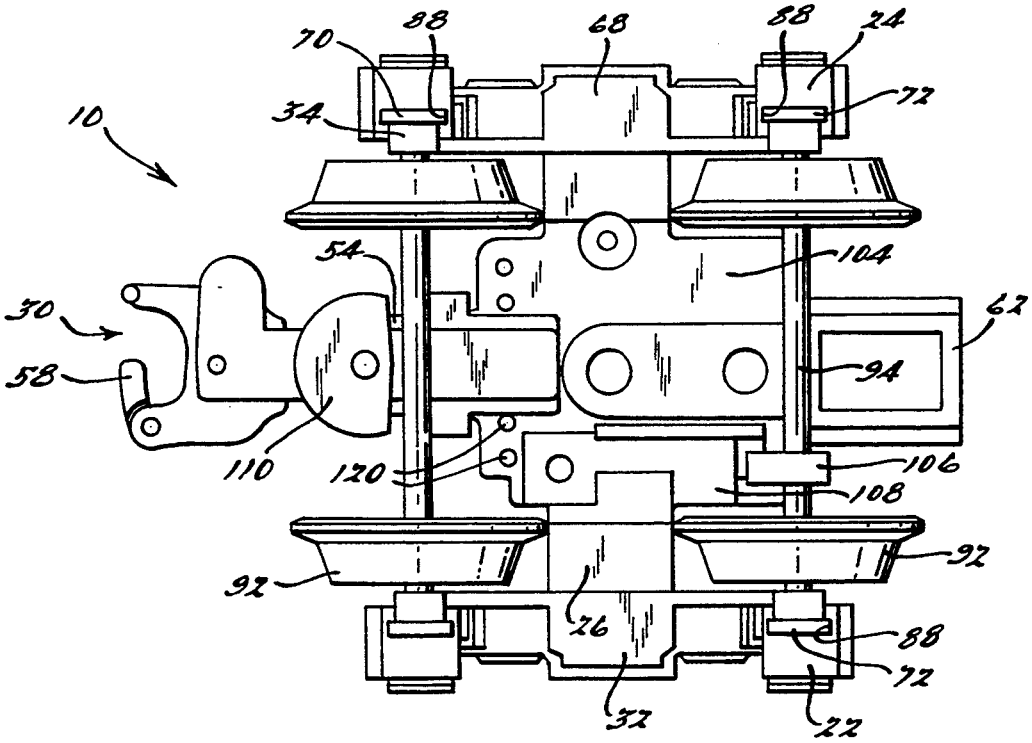
FIG. 5 is a bottom view of the truck assembly shown in FIG. 2 taken from line 5—5.

FIG. 5 illustrates a bottom view of the FIG. 2 truck assembly 10 whereby the underside 104 of the center plate 28 is shown with the inserts 32 and 34 positioned within the side frames 22 and 24, respectively. This figure further illustrates the employment of a sound means (an accessory) that includes a lobed cam 106 that is fixed to the axle 94 and is operable to intermittently contact a switch 108 to provide analog signals which are processed through a circuit board, an amplifier and a speaker (not shown), in order to generate digital sounds that replicate the sound of a train transversing a track. The switch 108 is connected to the underside of the frame 20 by conventional techniques as is well known in the art. The inserts 32 and 34 are further shown having their flanges 70 and 72 positioned within channels 88 while the coil retainer flange 68 is shown covering up the access hole 82 (not shown). And finally, a conventional magnetic armature plate 110 is part of the coupler arm assembly 30 and is connected in a conventional manner to the coupler armature 54 and is used to release the knuckle 58 so that the train truck 10 may be disconnected from a corresponding train truck.

Figure 6:
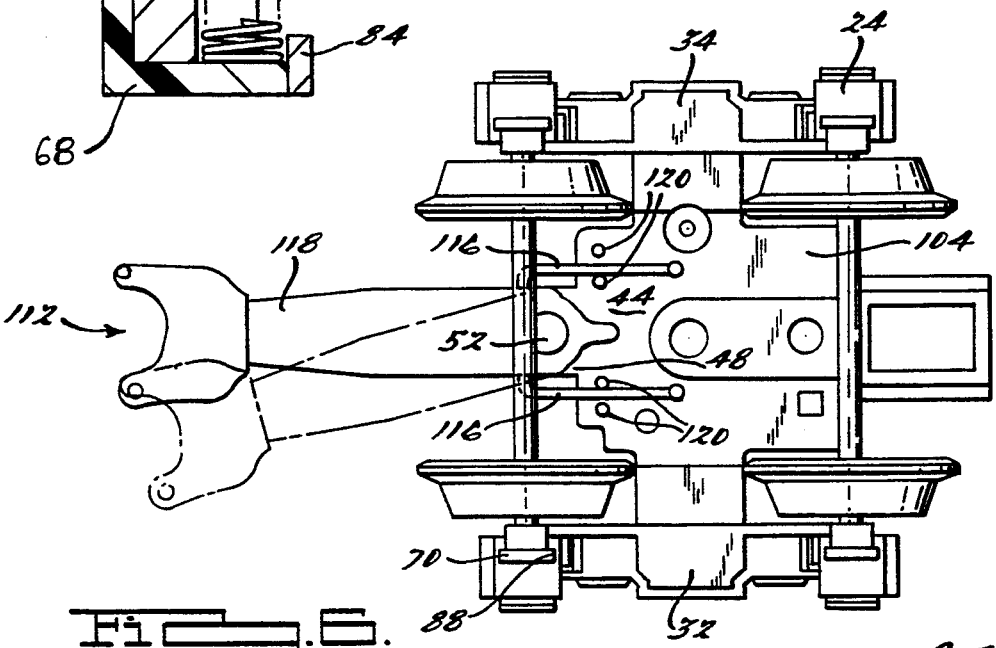
FIG. 6 is an alternative embodiment illustrating a bottom view of the truck assembly shown in FIG. 2 and shows an articulating coupler arm assembly.

FIG. 6 illustrates an alternative embodiment to the train truck assembly illustrated in FIG. 2 whereby an articulating coupler arm assembly 112 is shown pivotally connected to the flange 48 via a Standard snap-fit fastener 52 that provides for free rotation of a coupler arm 118. The articulating coupler arm assembly 112 is shown in solid lines in its centered position and is further illustrated in phantom in its off-centered position. The articulating coupler arm assembly 112 is preferably made of plastic and includes the primary components of the coupler arm assembly 30 as illustrated in FIG. 1, i.e., the coupler head, pivot pin and knuckle excluding fixed arm 54 (details of which are not illustrated), and further includes a pair of centering arms 116 that are integral with the coupler arm 118. The centering arms 116 are also made of plastic material and each centering arm 116 extends axially through a pair of metallic guide pins 120 that extend at right angles vertically outward from the underside of the lower plate 44. The centering arms 116 are naturally biased such that they have a self-centering action or tendency to center the coupler arm 118 at all times. As the train progresses through a curve, the coupler arm 118 progresses toward the position of the arm illustrated in phantom which causes the centering arms 116 to reposition accordingly (not shown).

Figure 7:
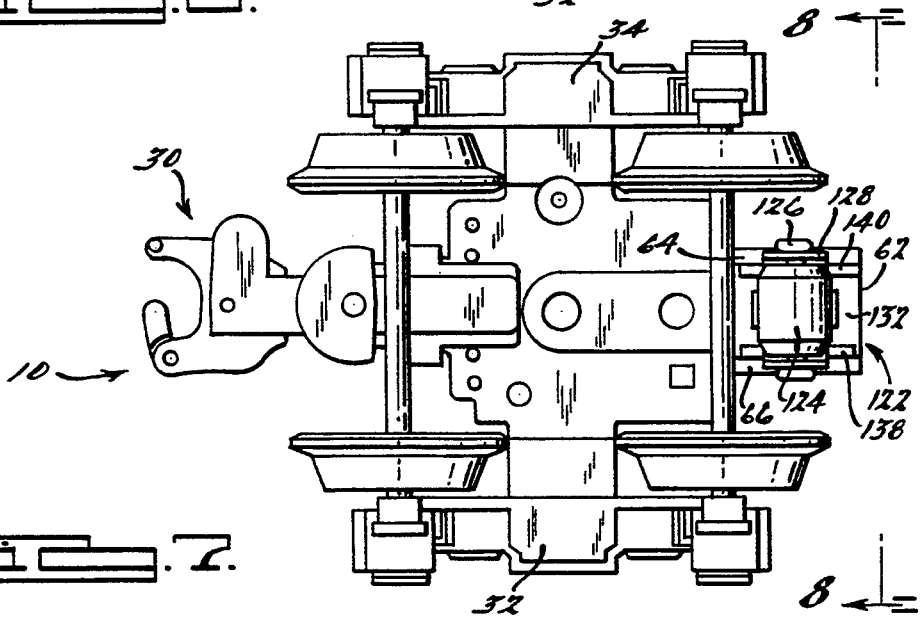
FIG. 7 is a bottom view of the truck assembly shown in FIG. 2 and shows a fixed coupler arm assembly and a roller pick-up contact assembly.
Figure 8:
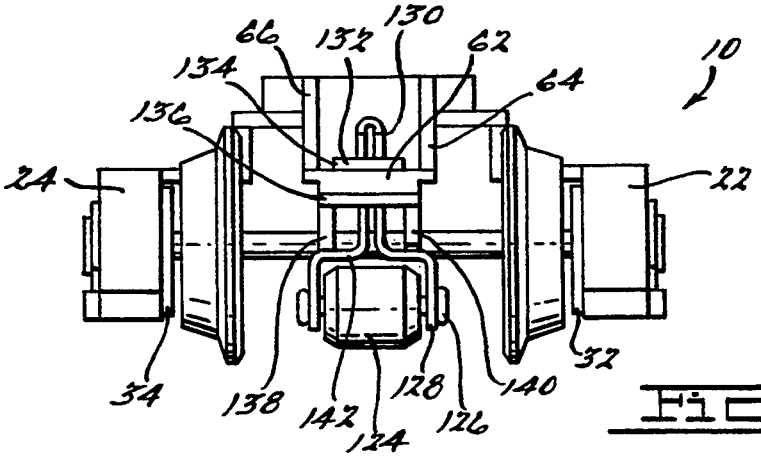
FIG. 8 is an end view of the truck assembly shown in FIG. 7 taken along line 8—8 and illustrates the roller pick-up.

FIGS. 7 and 8 illustrate another alternative embodiment of the FIG. 2 truck assembly whereby a roller pick-up assembly 122 is shown and is uniquely attached to the roller pick-up mounting flange 62. The roller pick-up assembly 122 includes a metallic roller 124 that is rotatably connected to a pin 126 which is journalled to a Y-shaped metallic mounting bracket 128. The Y-shaped mounting bracket 128 has an upwardly extending portion 130 that passes through a retainer clip 132 and the roller pick-up mounting flange 62. The retainer clip 132 includes an upper portion 134 and a lower portion 136 which sandwiches the mounting flange 62 and further includes a pair of integral downwardly positioned legs 138 and 140 that bias the Y-bracket 128 by reacting against a flattened surface 142 of the Y-bracket 128 in order to maintain the roller 124 in contact with the center rail (not shown) of the track. It is preferred that the Y-bracket 128, the pin 126 and the roller 124 be made of metal and the retainer clip 132 be made of plastic in order to assure performance.

Figure 9:
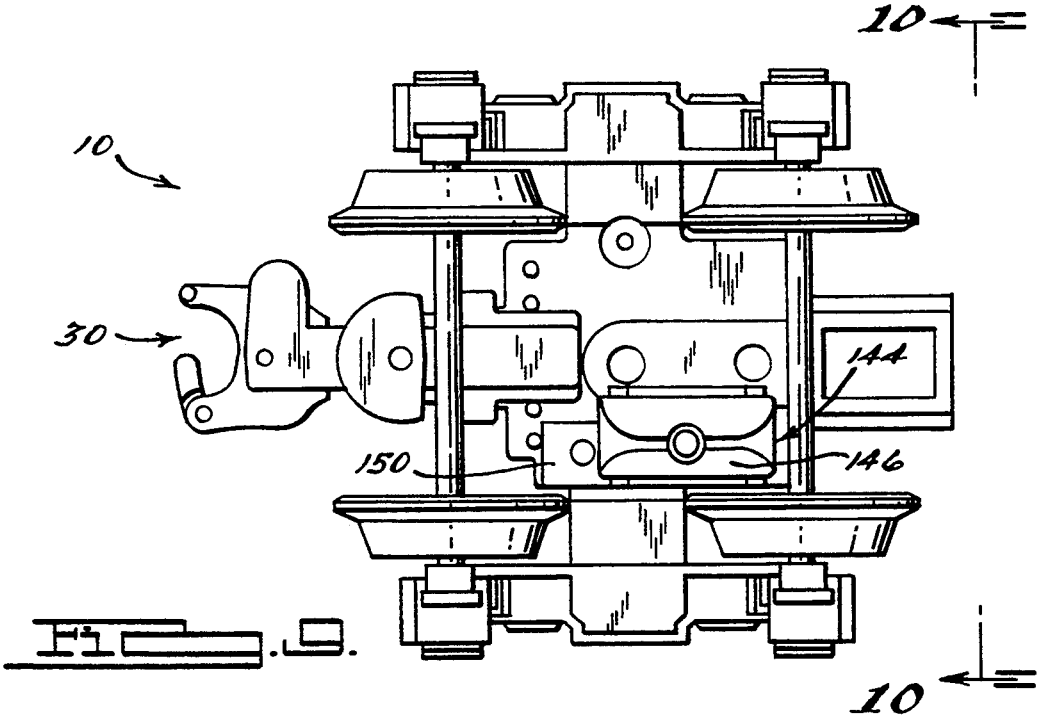
FIG. 9 is an alternative embodiment to the FIG. 2 truck assembly showing a slide contact accessory.
Figure 10:
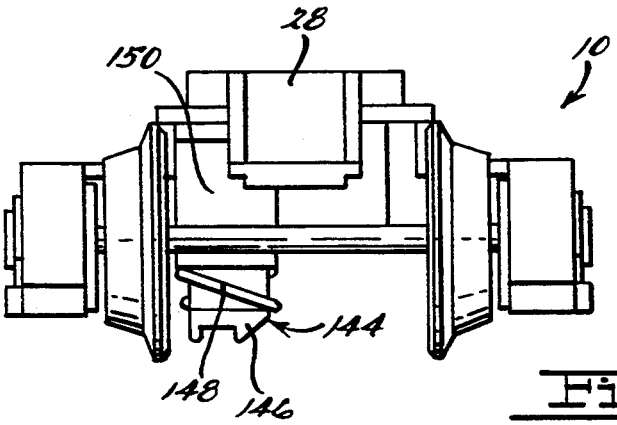
FIG. 10 is an end view of the FIG. 9 truck assembly taken from line 10—10 showing the slide contact accessory.

FIGS. 9 and 10 illustrate yet another alternative embodiment of the FIG. 2 truck assembly whereby an accessory slide contact assembly 144 is shown which includes a metallic slide contact shoe 146 that maintains contact with a fourth rail of the train track (not shown) in order to activate an accessory, for example, a light in a box car. A spring 148 naturally biases thee shoe 146 downward so that it maintains contact against the fourth rail of the train track. The shoe 146 is mounted in a conventional manner to a slide contact mounting plate 150 which is connected to the underside of the frame 20. The remaining components of the slide contact assembly 144 and its operation are conventional in nature and are well known in the art.

The roller pick-up assembly 122 and the slide contact assembly 144 are but two examples of accessories that may be connected to the modular toy train truck assembly 10. It will be appreciated that this modular train truck assembly 10 may be modified to utilize other accessories. Such accessories may be used irrespective of the type of side frames that are being employed, i.e. those side frames illustrated in FIGS. 2, 3 and 4. Furthermore, because of this modular toy train truck assembly design, either fixed coupler arms or articulating coupler arms may be used and easily retrofitted to this truck frame 20 irrespective of the type of side frames that are being used. This generic design, of course, offers a great deal of flexibility to the user, as well as the manufacturer, to provide various combinations of truck assemblies by using a generic or modular truck frame.

Figure 11:
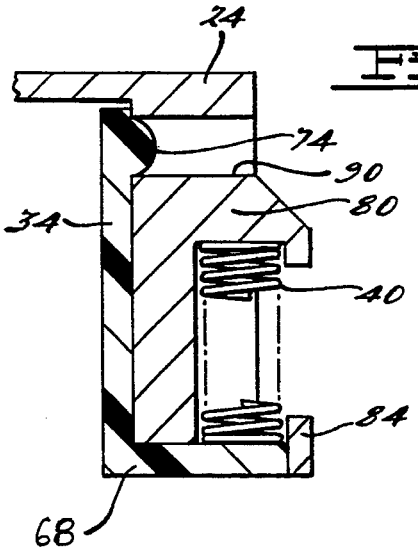
FIG. 11 is a partial sectional view taken along line 11—11 of FIG. 2 showing how the side frame, the insert and the coil spring are interconnected.

FIG. 11 is a sectional view taken along line 11—11 of FIG. 2 which illustrates the plastic insert 34 snapped into and engaging with side frame 24. Specifically, the tab 74 is shown recessed within slot 90 of the side frame and the coil retainer flange 68 is shown encapsulating coil 40 thus preventing the coil 40 from falling out of the coil housing 80. It will be appreciated that the inserts 32 and 34 will engage the side frames illustrated in FIGS. 3 and 4 in a similar fashion as just described. Again, this points to another advantage of the modular truck design, that is, a common insert 34 can be employed with the various side frames 24, 200 and 220. It will further be appreciated that side frames other than that which is shown may be utilized with this modular truck assembly 10.

The foregoing discussion discloses and describes merely exemplary embodiments of the present invention. One skilled in the art will readily recognize from such discussion and from the accompanying drawings and claims, that various changes, modifications and variations can be made therein without departing from the spirit and scope of the invention as defined in the following claims.

I claim:

1. A truck for a railway train comprising:

a frame including a bolster and a pair of side frames, and having a length and a width;

a coupler structure connected to said frame;

an insert extending essentially the length of said frame and including a vertically sliding component received within said frame; and two wheel assemblies directly mounted by said insert.

2. The truck of claim 1, wherein Said side frames include channels formed therein, said channels being operable to receive said insert.

3. The truck of claim 1 further comprising springs located within said side frames.

4. The truck of claim 1, wherein said side frames include spring housing means.

5. The truck of claim 1, wherein said insert includes a spring retaining flange.

6. The truck of claim 1, wherein each of said wheel assemblies includes an axle and a pair of wheels, and wherein said insert includes axle retaining means.

7. The truck of claim 1, wherein said coupler structure includes a coupler head and a coupler arm, said coupler structure being operable to articulate about a fixed axis relative to said frame.

8. The truck of claim 7, wherein said coupler structure further includes integral coupler structure centering means.

9. The truck of claim 1, wherein said coupler structure includes a coupler head and an uncoupler arm, said coupler structure being fixed to said frame.

10. The truck of claim 1 further comprising an accessory connected to said frame.

11. A truck for a toy railway train comprising:

a frame including an Integral bolster and a pair of side frames;

a coupler arm connected to said frame and an uncoupler assembly connected to said coupler arm;

an insert extending essentially the length of the frame and positioned within said side frames, said insert including a locking structure having a longitudinally extending member that is received in a complementary recess in said frame, said longitudinally extending member and said complementary recess extending along the longitudinal axis of the truck;

a wheel assembly including an axle rotatably journalled with said insert; and spring means located within said side frames.

12. The truck of claim 11, wherein said inserts further include bearing means.

13. The truck of claim 11, wherein said insert includes:

a spring retaining structure operable to retain a spring within each of said side frames; and bearing means for journalling said axle.

14. The truck of claim 11 further comprising a train accessory connected to said frame.

15. The truck of claim 11, wherein said side frames are shaped like that of a freight truck.

16. The truck of claim 11, wherein said side frames are shaped like that of a passenger truck.

17. The truck of claim 11, wherein said side frames are shaped like that of a caboose truck.

18. A modular truck for a train comprising:

a frame including a pair of side frames, each comprising a pair of spaced-apart vertically extending channels; and a universal chassis assembly, cooperating with said channels, including a spring retaining structure operable to retain a spring within each of said side frames, bearing means for journalling a wheel assembly, and locking means for securing said universal chassis assembly to said side frames.

19. The truck of claim 18 wherein said universal chassis assembly includes a wheel assembly and an insert structure.

* * * * *

UNITED STATES PATENT AND TRADEMARK OFFICE

CERTIFICATE OF CORRECTION

PATENT NO. : 5,398,619

DATED : March 21, 1995

INVENTOR(S) : Peter C. Buccos

It is certified that error appears in the above-indentified patent and that said Letters Patent is hereby corrected as shown below:

Column 1, line 12, ";various" should be --various--.

Column 1, line 24, "matter" should be --manner--.

Column 1, line 28, ":" should be --.--.

Column 1, line 55, delete ";,".

Column 2, line 6, "Springs" should be --springs--.

Column 2, line 23, "With" should be --with--.

Column 2, line 37, "For" should be --From--.

Column 3, line 54, "Or" should be --or--.

Column 4, line 8, delete ";.".

Column 4, line 11, delete "and" (second occurrence).

Column 5, line 26, "Standard" should be --standard--.

Column 6, line 7, "thee" should be --the--.

UNITED STATES PATENT AND TRADEMARK OFFICE

CERTIFICATE OF CORRECTION

PATENT NO. : 5,398,619

DATED : March 21, 1995

INVENTOR(S) : Peter C. Buccos

It is certified that error appears in the above-indentified patent and that said Letters Patent is hereby corrected as shown below:

Column 6, line 64, Claim 2, "Said" should be --said--.

Column 7, line 22, Claim 11, "Integral" should be --integral--.

Signed and Sealed this

Twenty-fourth Day of October, 1995

*Attest:*

*Attesting Officer*

Bruce Lehman

BRUCE LEHMAN

*Commissioner of Patents and Trademarks*